US005693443A

United States Patent [19]

Nakamura et al.

[11] Patent Number: 5,693,443

[45] Date of Patent: Dec. 2, 1997

[54] ELECTROPHOTOGRAPHIC PHOTOSENSITIVE MEMBER, AND PROCESS CARTRIDGE AND ELECTROPHOTOGRAPHIC APPARATUS HAVING THE SAME

[75] Inventors: Kazushige Nakamura, Yokohama; Akio Maruyama, Tokyo; Noriyuki Takagi, Kawasaki; Michiyo Sekiya, Tokyo, all of Japan

[73] Assignee: Canon Kabushiki Kaisha, Tokyo, Japan

[21] Appl. No.: 746,980

[22] Filed: Nov. 19, 1996

[51] Int. Cl.[6] ..... G03G 5/147

[52] U.S. Cl. ..... 430/66; 399/297

[58] Field of Search ..... 430/66; 399/297

[56] References Cited

U.S. PATENT DOCUMENTS

| | | | |
|---|---|---|---|
| 4,687,723 | 8/1987 | Oshima et al. | 430/65 |
| 5,385,797 | 1/1995 | Nagahara et al. | 430/67 |
| 5,391,446 | 2/1995 | Ohtani et al. | 430/58 |
| 5,391,449 | 2/1995 | Maruyama et al. | 430/66 |
| 5,422,210 | 6/1995 | Maruyama et al. | 430/59 |
| 5,455,135 | 10/1995 | Maruyama et al. | 430/58 |

FOREIGN PATENT DOCUMENTS

| | | | |
|---|---|---|---|
| 0587105 | 3/1994 | European Pat. Off. | C09C 1/02 |
| 57-30846 | 2/1982 | Japan . | |

OTHER PUBLICATIONS

Patent Abstracts of Japan, vol. 14, No. 445 (P–1110) 9/90 for JP 02–176666.

Patent Abstracts of Japan, vol. 11, No. 12 (P–535 1/87 for JP 61–188544.

*Primary Examiner*—John Goodrow

*Attorney, Agent, or Firm*—Fitzpatrick, Cella, Harper & Scinto

[57] ABSTRACT

The present invention relates to an electrophotographic photosensitive member, a process cartridge and an electrophotographic apparatus. The electrophotographic photosensitive member includes a support, a photosensitive layer provided on the support, and a surface layer provided on the photosensitive layer. The surface layer includes tantalum-doped tin oxide particles and a resin.

12 Claims, 1 Drawing Sheet

ELECTROPHOTOGRAPHIC PHOTOSENSITIVE MEMBER, AND PROCESS CARTRIDGE AND ELECTROPHOTOGRAPHIC APPARATUS HAVING THE SAME

BACKGROUND OF THE INVENTION

1. Field of the Invention

The present invention relates to an electrophotographic photosensitive member and, in particular, relates to an electrophotographic photosensitive member having a surface protective layer. The present invention also relates to a process cartridge and an electrophotographic apparatus which have the foregoing electrophotographic photosensitive member.

2. Description of the Related Art

The surface of an electrophotographic photosensitive member is required to be durable enough to withstand direct electrical or mechanical forces due to charging, light exposure, transferring, cleaning, and the like. The practical durability is required to resist abrasion or flaws caused by contact with toner, paper, or cleaning members, and to resist deterioration due to the adhesion of active materials, such as ozone and NOx.

For achieving the above-mentioned properties, various kinds of protective layers have been employed for electrophotographic photosensitive members and, particularly, those which essentially consist of a resin have been proposed in great numbers. For example, Japanese Patent Laid-Open No. 57-30846 discloses a surface protective layer comprising a resin and conductive metal-oxide particles. In this prior art, zinc oxide, titanium oxide, and tin oxide which is doped with antimony oxide are proposed as a metal oxide for the surface protective layer.

However, when a conductive metal oxide which lacks absorption in a range of visible light to near infrared light, for example, zinc oxide or titanium oxide, is used for the particles of the protective layer, sufficient conductivity is not achieved, though the layer is highly transparent. On the other hand, when tin oxide doped with antimony oxide is used, the transparency of the layer is insufficient, although the conductivity increases.

From the foregoing views, Japanese Patent Laid-Open No. 57-30846 discloses a surface protective layer obtained by dispersing metal-oxide fine particles having an average diameter of 0.3 μm, which layer is substantially transparent with respect to visible light. However, according to this method, a large quantity of metal-oxide fine particles is required to achieve sufficient conductivity, thus resulting in insufficient transparency and a decrease in the strength of the surface protective layer.

SUMMARY OF THE INVENTION

Accordingly, it is an object of the present invention to provide an electrophotographic photosensitive member having a surface protective layer which exhibits excellent light transmittance and high conductivity, and a process cartridge and an electrophotographic apparatus which have the electrophotographic photosensitive member.

Further, another object of the present invention is to provide an electrophotographic photosensitive member which reliably provides high-quality images regardless of repeated use, and a process cartridge and an electrophotographic apparatus provided with the electrophotographic photosensitive member.

In other words, the present invention is an electrophotographic photosensitive member comprising a support, a photosensitive layer provided on the support, and a surface layer provided on the photosensitive layer, wherein the surface layer comprises tantalum-doped tin oxide particles and a resin.

Further, the present invention includes a process cartridge and an electrophotographic apparatus which have the electrophotographic photosensitive member.

DESCRIPTION OF THE PREFERRED EMBODIMENT

Figure 1:
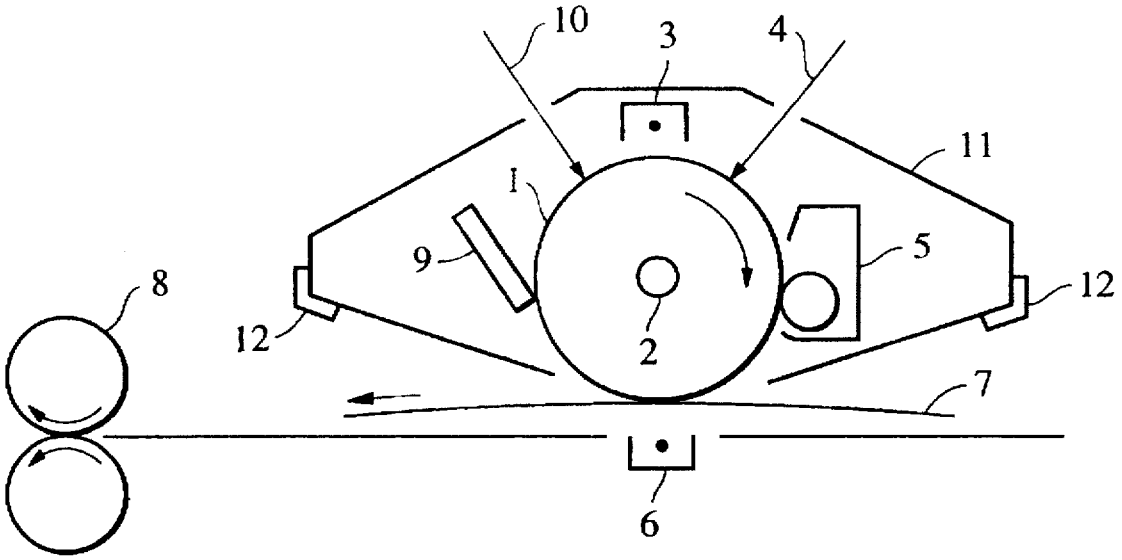
FIG. 1 shows an electrophotographic apparatus which has a process cartridge provided with an electrophotographic photosensitive member of the present invention.

The present invention is an electrophotographic photosensitive member comprising a support, a photosensitive layer provided on the support, and a surface layer provided on the photosensitive layer, wherein the surface layer comprises tantalum-doped tin oxide particles and a resin.

In the present invention, the tin oxide is doped with a tantalum compound in its crystal lattice. Examples of the tantalum compound are tantalum, tantalum oxides, e. g., $Ta_2O_5$, and halogenated tantalum compounds, e. g., $TaCl_5$. Among them, tantalum oxides are more preferable, and $Ta_2O_5$ is most preferable. The preferable quantity of the doped tantalum compound is 1 to 50% by weight of the tin oxide and, more preferably, 2 to 20% by weight. The above-mentioned tin oxide doped with tantalum can be prepared by a conventional doping method, such as alloying or diffusion.

According to the present invention, the tin oxide doped with tantalum exhibits similar conductivity to tin oxide doped with antimony and indium oxide doped with tin oxide. When the doped tin oxide is dispersed in a film, the resultant film attains similar transparency to a film containing dispersed zinc oxide and titanium oxide.

In the present invention, the resistivity of the tin oxide doped with tantalum is preferably $10^2$ Ω·cm or less. If it exceeds $10^2$ Ω·cm, the surface layer cannot easily attain the preferable conductivity. The resistivity is measured according to the following method:

First, a disk-shaped pellet having a diameter of 4 cm and a thickness of 0.2 cm is prepared from a sample by applying pressure of 100 kg/cm$^2$ to the sample. Then, the resistivity ρv (Ω·cm) of the pallet is measured by using a Hiresta AP apparatus (manufactured by Mitsubishi Petrochemical Corporation).

In addition, according to the present invention, the average diameter of the primary particles of the tin oxide doped with tantalum is preferably 0.3 μm or less and, more preferably, 0.1 μm or less to provide further transparency for the layer. The average diameter of the particles can be obtained by measuring diameters of a hundred particles chosen at random with the transmission electron microscope (TEM).

The surface layer of the present invention contains tin oxide doped with tantalum and a binder resin. The preferable content of the tin oxide of the present invention is 40 to 85% by weight based on the total weight of the surface layer and, more preferably, 50 to 75% by weight. If the content is less than 40% by weight, sufficient conductivity is not readily achieved when the content exceeds 85% by weight, the mechanical strength of the layer becomes insufficient.

Examples of the binder resin are a polycarbonate resin, a polyester resin, a polyarylate resin, a polystyrene resin, a polyethylene resin, a polypropylene resin, a polyurethane resin, an acrylic resin, an epoxy resin, a silicone resin, a cellulose resin, a polyvinyl chloride resin, a phosphazen resin, a melamine resin, a vinyl chloride-vinyl acetate copolymer, and the like. These binder resins may be used alone or in combination with others.

Among the foregoing binder resins, curable resins are preferably used because they are advantageous in hardness, abrasion resistance, particle dispersibility, and dispersion stability of the surface layer. When a curable resin is employed, the protective layer is formed as follows: A coating liquid is prepared by dispersing tin oxide particles of the present invention in a solution which contains a thermo- or photo-setting monomer or oligomer, coating the dispersion on a photosensitive layer, drying the coated layer, and exposing the dried layer to heat or light so that the curable film is cured to form a protective layer. Examples of the curable resin are acrylic, epoxy, phenol, and melamine resins.

In the present invention, the tin oxide particles may be surface-treated with a finishing agent for improving particle dispersibility and dispersion stability and also for preventing environmental changes which affect the resistance of the surface layer. Various kinds of silane coupling agents, silicone oils, siloxane compounds, surface active agents, and the like are employed as the finishing agent for the surface treatment. Fluoro-substituted finishing agents are preferred. In particular, fluorine-containing compounds are preferably used as the finishing agents, because they are advantageous in tin oxide particle dispersibility and dispersion stability.

Non-limiting examples preferably used for the above-mentioned compounds will be given below.

Preferred examples of the fluorine-containing silane coupling agents are as follows:

$CF_3CH_2CH_2Si(OCH_3)_3$.
$C_4F_9CH_2CH_2Si(OCH_3)_3$.
$C_6F_{13}CH_2CH_2Si(OCH_3)_3$.
$C_8F_{17}CH_2CH_2Si(OCH_3)_3$.
$C_8F_{17}CH_2CH_2Si(OCH_2CH_2OCH_3)_3$.
$C_{10}F_{21}Si(OCH_3)_3$.
$C_6F_{13}CONHSi(OCH_3)_3$.
$C_8F_{17}CONHSi(OCH_3)_3$.
$C_7F_{15}CONHCH_2CH_2CH_2Si(OCH_3)_3$.
$C_7F_{15}CONHCH_2CH_2CH_2Si(OC_2H_5)_3$.
$C_7F_{15}COOCH_2CH_2CH_2Si(OCH_3)_3$.
$C_7F_{15}COSCH_2CH_2CH_2Si(OCH_3)_3$.
$C_8F_{17}SO_2NHCH_2CH_2CH_2Si(OC_2H_5)_3$.

$$C_8F_{17}SO_2\underset{\underset{CH_2CH_2CH_3}{|}}{N}CH_2CH_2CH_2Si(OCH_3)_3.$$

$C_8F_{17}CH_2CH_2SCH_2CH_2Si(OCH_3)_3$.
$C_{10}F_{21}CH_2CH_2SCH_2CH_2Si(OCH_3)_3$.

$$C_7F_{15}CONHCH_2CH_2\underset{\underset{COC_7F_{15}}{|}}{N}CH_2CH_2CH_2Si(OCH_3)_3.$$

$$C_7F_{15}SO_2NHCH_2CH_2\underset{\underset{SO_2C_8F_{17}}{|}}{N}CH_2CH_2CH_2Si(OCH_3)_3.$$

Preferred examples of fluorine-modified silicone oils are the compounds having the following formula:

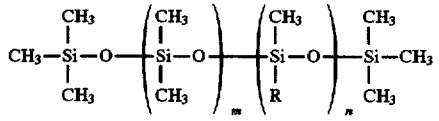

wherein R is $—CH_2CH_2CF_3$, m and n are positive integers.

Preferred examples of fluorinated surface-active agents are the compounds having the following formula:

$X—SO_2NRCH_2COOH$.
$X—SO_2NRCH_2CH_2O(CH_2CH_2O)_nH$ (n=5. 10. 15).
$X—SO_2N(CH_2CH_2CH_2OH)_2$.
$X—RO(CH_2CH_2O)_n$ (n=5. 10. 15).
$X—(RO)_n$(n=5~20).
$X—(RO)_nR$(n=5~20).

$$X—SO_2NRCH_2\underset{\underset{O}{\backslash/}}{CHCH_2}.$$

X—COOH, $X—CH_2CH_2COOH$.
X—ORCOOH.
$X—ORCH_2COOH$. $X—SO_3H$.
$X—ORSO_3H$.
$X—CH_2CH_2OH$.

$$X—CH_2OCH_2\underset{\underset{O}{\backslash/}}{CHCH_2}$$

$$X—CH_2CH_2OCH_2\underset{\underset{O}{\backslash/}}{CHCH_2}$$

$$X—CO_2CH_2\underset{\underset{O}{\backslash/}}{CHCH_2}$$

wherein R is an alkyl, allyl, or aralkyl group; and X is a fluorinated carbon group including $—CF_3$, $—C_4F_9$, and $—C_8F_{17}$.

The surface treatment of the tin oxide particles of the present invention is conducted preferably as follows:

First, by conventional dispersion means, such as a ball mill and a sand mill, the tin oxide particles of the present invention and a finishing agent are mixed and dispersed in an appropriate solvent so that the finishing agent adheres to the surface of the particles. The solvent is removed from the dispersion so as to fix the finishing agent to the particle surface. If required, a heat treatment may also be employed. Furthermore, a catalyst may be added to the treatment solution for accelerating the reaction. In addition, the resultant tin oxide particles may be further subjected to a pulverizing process, as needed. The preferable content of the adhered finishing agent is 1 to 65% by weight based on the total weight of the tin oxide and, more preferably, 5 to 50% by weight, although the content may vary according to the size of the tin oxide particles.

In the present invention, fluorine-containing resin particles may be added to the surface protective layer for improving the separating properties, water-proofing, and surface smoothness of the layer. Examples of a fluorine-containing resin employed for the particles are tetrafluoroethylene, trifluorochloroethylene, hexafluoropropylene, vinyl fluoride, vinylidene fluoride, and difluorodichloro ethylene resins, and copolymers thereof. These are used alone or combined with others, depending on the conditions. Among these, tetrafluoroethylene and vinylidene fluoride resins are particularly preferable. The molecular weight and the size of the particles are not limited to certain values and may be selected according to ambient conditions.

The content of the fluorine-containing resin particles is preferably 70% or less by weight of the total weight of the surface layer and, more preferably, 10 to 60% by weight. If the content is more than 70% by weight, the mechanical strength of the resultant layer occasionally becomes insufficient.

The resistivity of the surface layer of the present invention is preferably $10^{10}$ to $10^{15}$ Ω·cm and, more preferably, $10^{11}$ to $10^{14}$ Ω·cm. If the resistivity is less than $10^{10}$ Ω·cm, it becomes difficult to retain the charge, resulting in image flow. When it is more than $10^{15}$ Ω·cm, the charge is not readily moved, resulting in light image and negative ghost. The resistivity is measured according to the following method:

First, a 4-μm-thick (T) surface layer of the present invention is formed on comb-shaped platinum electrodes having an inter-electrode distance (D) of 180 μm and a length (L) of 5.9 cm. Then, a DC voltage (V) of 100 V is applied between the electrodes to measure the current value (I) by a pA (pico ampere). meter. The resistivity ρv (Ω·cm) is calculated from the following formula:

$$\rho v\,(\Omega\cdot\mathrm{cm}) = \frac{V\,(V)}{I\,(A)} \times \frac{T\,(\mathrm{cm}) \times L\,(\mathrm{cm})}{D\,(\mathrm{cm})}$$

In the present invention, an additive, such as the finishing agent or an anti-oxidant, may be added to the surface layer for improving the dispersibility, binding properties, weatherability, and the like.

The preferable thickness of the surface layer of the present invention is 0.2 to 10 μm and, more preferably, 0.5 to 6 μm.

Next, the support of the electrophotographic photosensitive member of the present invention will be explained. Any conductive material can be used as a support. Typical conductive materials include: a sheet- or drum-shaped metal, such as aluminum, an aluminum alloy, copper, zinc, stainless steel, vanadium, molybdenum, chromium, titanium, nickel, or indium; plastic films laminated with metal foil, such as aluminum or copper foil; plastic films deposited with aluminum, indium oxide, tin oxide, or the like; and metals, plastic films, and paper on which a conductive material alone or combined with a binder resin is applied to make conductive layers.

Although the support can be formed in the shape of a drum, sheet, belt, or the like, it is desirable to select the most suitable form to be used in the corresponding electrophotographic apparatuses.

Next, the photosensitive layer of an electrophotographic photosensitive member of the present invention will be explained. The photosensitive layers are usually classified as monolayer types in which both a charge generation material and a charge transport material are mixed in the same layer or multilayer types which comprise a separate charge generation layer and a separate charge transport layer.

The following materials can be used for a charge generation layer of a multilayer type photosensitive layer: inorganic charge generation materials, such as selenium, selenium-tellurium, and amorphous silicon; cationic dyes, such as pyrilium, thiapyrilium, azulenium, thiacyanine, and quinocyanine dyes; squarium salt pigments; phthalocyanine pigments; anthanthrone pigments; polycyclicquinone pigments, such as dibenzpyrenequinone pigments and pyranthrone pigments; indigo pigments; quinacridone pigments; azo pigments and the like. A charge generation layer is obtained (i) as a deposition layer by vacuum-evaporating the foregoing materials or (ii) as a coated layer by applying and drying a coating liquid which is prepared by dispersing or dissolving the foregoing materials in a binder resin.

The binder resin is selected from various kinds of insulating resins and may be also selected from organic photoconductive polymers, such as poly-N-vinylcarbazole and polyvinyl pyrene. Preferable examples for the binder resin are polyvinyl butyral, polyarylates (e.g., those which are obtained from copolycondensation of bisphenol A and phthalic acid), polycarbonates, polyesters, polyvinyl acetate, acrylic resins, polyacrylic amide, polyamides, cellulose resins, urethane resins, epoxy resins, and polyvinyl alcohol.

The binder resin is preferably contained in a charge generation layer in the amount of 80% or less by weight based on the total weight of the charge generation layer and, more preferably, 50% or less by weight.

The preferable thickness of the charge generation layer is 5 μm or less and more preferably, 0.01 to 1 μm.

A charge transport layer can be obtained by applying and drying a coating liquid which is prepared by dissolving a charge transport material in a binder resin. Examples of the charge transport material are: polynuclear aromatic compounds of which the principal chain or the side chain has biphenylene, anthracene, pyrene, phenanthrene, and the like; nitrogen containing cyclic compounds, such as indole, carbazole, oxadiazole, and pyrazoline; hydrazone compounds and styryl compounds.

Examples of the binder resin are: a polyarylate, polysulfone resin, polyamide resin, acrylic resin, acrylonitrile resin, methacrylate resin, vinyl chloride resin, vinyl acetate resin, phenol resin, epoxy resins, polyester resin, alkyd resin, polycarbonate resin, polyurethane resin, and copolymers thereof, e.g., a styrene-butadiene copolymer, a styrene-acrylonitrile copolymer, and a styrene-maleate copolymer. In addition to these insulating polymers, organic photoconductive polymers, such as polyvinyl carbazole, polyvinyl anthracene, and polyvinyl pyrene can be used.

Preferably, 100 parts by weight of a binder resin is used with 10 to 500 parts by weight of a charge transport material.

The thickness of the charge transport layer is preferably 5 to 40 μm and, more preferably, 10 to 30 μm.

A photosensitive layer of a monolayer type can be obtained by dispersing or dissolving the foregoing charge generation and charge transport materials in the foregoing binder resin to form a coating liquid and then applying the coating liquid to a support followed by drying.

According to the present invention, an undercoating layer may be provided between the support and the photosensitive layer so as to work as a barrier and an adhesive between the layers.

The following materials can be used for the undercoating layer: polyvinyl alcohol, polyethylene oxide, nitrocellulose, ethylcellulose, methylcellulose, ethylene-acrylic copolymers, alcohol-soluble amides, polyamides, polyurethanes, casein, glue, gelatin, and the like. The undercoating layer can be formed such that a solution prepared by dissolving the foregoing materials in an appropriate solvent is applied to a support followed by drying. The thickness of the undercoating layer is preferably 5 μm or less and, more preferably, 0.2 μm to 3 μm.

When laser light is used for exposure of the photosensitive layer, it is preferable to provide a conductive layer between the undercoating layer and the support so as to prevent formation of an interference fringe. The conductive layer can be obtained by dispersing carbon black and conductive powder, e.g. metal particles, in a binder resin to form a solution and applying the solution to a support followed by drying. The thickness of the conductive layer is preferably 5 to 40 μm and, more preferably, 5 μm to 30 μm.

Using an appropriate solvent, each of the layers mentioned above can be formed by a coating method, such as dip coating, spray coating, beam coating, spinner coating, roller coating, Meyer bar coating, or blade coating.

FIG. 1 shows a diagram of an electrophotographic apparatus which has a process cartridge provided with an electrophotographic photosensitive member of the present invention.

According to the following process, an electrostatic latent image is formed on the peripheral face of a drum-shaped electrophotographic photosensitive member 1 of the present invention. At a predetermined peripheral velocity, the electrophotographic photosensitive member 1 is rotary-driven in the direction of the arrow around an axis 2. During rotation, the peripheral face of the electrophotographic photosensitive member 1 is uniformly charged to a predetermined positive or negative voltage by a primary charging means 3, and then subjected to image exposure light 4 from an image exposure means (not shown in the FIGURE), such as slit exposure or laser-beam-scanning exposure.

The electrostatic latent image formed on the electrophotographic photosensitive member 1 is toner-developed by a developing means 5 and then, by a transfer means 6, transferred to a transfer medium 7 which is fed between the electrophotographic photosensitive member 1 and the transfer means 6 in synchronism with the rotation of the electrophotographic photosensitive member 1 from a feeding section (not shown in the FIGURE).

The transfer medium 7 to which the image is transferred is separated from the surface of the electrophotographic photosensitive member 1, introduced into a image-fixing means 8 in which the image is fixed, and fed out from the apparatus as a copy.

After transferring the image, the toner left on the surface of the electrophotographic photosensitive member 1 is cleaned by a cleaning means 9. Then, the electrophotographic photosensitive member 1 is subjected to pre-exposure light 10 from a pre-exposure means (not shown in the FIGURE) to remove the charge so that it can be repeatedly used for image forming. When a contact-type means, such as a charging roller, is employed as the primary charging means 3, pre-exposure is not always necessary.

In the present invention, a plurality of components among the above-mentioned electrophotographic photosensitive member 1, primary charging means 3, developing means 5, and cleaning means 9 may be integrated as a process cartridge which is detachable to a main body of an electrophotographic apparatus, such as a copying machine or a laser beam printer. For example, at least one of the primary charging means 3, developing means 5, and cleaning means 9 can be integrated with the electrophotographic photosensitive member 1 to form a process cartridge 11 which is supported as one body and detachable to a main body of an apparatus by utilizing guiding means, e.g., rails 12 of the main body Practical examples of the present invention will be described below. These examples illustrate certain preferred embodiments and are not limitative of scope. The term "part" used in those examples represents a part by weight.

EXAMPLE 1

An aluminum cylinder having a diameter of 30 mm and a length of 260 mm was used as a support. A conductive layer 15 μm thick was formed by applying a solution having the following composition to the support by dip coating, followed by heating at 140° C. for 30 min:

| Ingredient | Amount |
|---|---|
| Conductive pigment: titanium oxide coated with tin oxide | 10 parts |
| Resistance-regulating pigment: titanium oxide | 10 parts |
| Binder resin: phenol resin | 10 parts |
| Leveling agent: silicone oil | 0.001 part |
| Solvent: methanol/methylcellosolve = 1/1 | 20 parts |

Then, 10 parts of an alcohol-soluble polyamide resin (trade name: Amilan CM-8000, manufactured by Toray Industries, Inc.) and 30 parts of a methoxymethylated 6 nylon resin (trade name: Toresin EF-30T, manufactured by Teikoku Chemical Industries, Co., Ltd.) were dissolved in a mixed solvent composed of 150 parts of methanol and 150 parts of buthanol. The resultant solution was applied to the conductive layer by dip coating followed by drying at 90° C. for 10 min. to form an undercoating layer of 0.5 μm thick.

Then, 4 parts of phthalocyanine oxytitanium having sharp peaks at diffraction angles (2θ±0.2°) of 9.0°, 14.2°, 23.9°, and 27.1° in CuKα characteristic X-ray diffraction, 2 parts of polyvinyl butyral (trade name: S-LEC BM-2, manufactured by Sekisui Chemical Co., Ltd.), and 80 parts of cyclohexanone were dispersed for 4 hours by a sand mill with glass beads having a diameter of 1 mm, and then 115 parts of methyl ethyl ketone was added thereto. The resultant solution was applied to the undercoating layer by dip coating followed by drying to obtain a charge generation layer 0.3 μm thick.

In a mixed solvent of 30 parts of monochlorobenzene and 30 parts of dichloromethane, there were dissolved 10 parts of a polycarbonate resin (trade name: IUPILON Z-200, manufactured by Mitsubishi Gas Chemical Company, Inc.) and 8 parts of an amine compound having the following formula:

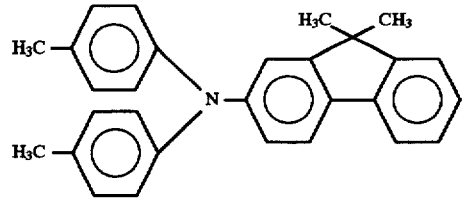

The resultant solution was applied to the charge generation layer by dip coating followed by drying at 110° C. for 1 hour to form a charge transport layer 18 μm in thickness.

Then a protective layer (surface layer) was prepared as explained below.

The following materials were mixed and dispersed for 96 hours by a sand mill: 100 parts of $Ta_2O_5$-doped tin oxide particles, the primary particles of which had an average diameter of 0.02 μm and the resistivity of which was $2\times10^1$ Ω·cm; 12 parts of 2,4-diethylthioxanthone, as an initiator for photopolymerization; 300 parts of toluene; and 60 parts of acrylic monomer having the following formula:

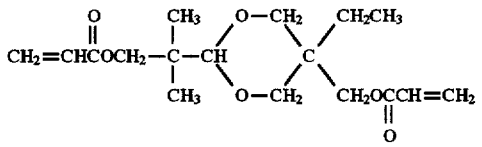

The resultant solution was applied to the charge transport layer by spray coating followed by drying. Next, ultraviolet radiation was applied for 20 seconds at 500 mW/cm$^2$ using a high-pressure mercury lamp to form a protective layer 4 μm thick. The resistivity of a layer prepared according to the same method as this protective layer was $3\times10^{12}$ Ω·cm, when measured by the above-mentioned manner.

An electrophotographic photosensitive member produced according to the foregoing manner was stored at 23° C. and at 45% RH (relative humidity) overnight. After storage, the electric potential of the member was measured using a laser beam printer LBP-NX (manufactured by Canon Inc.), as follows:

First, a developer unit and a cleaner were removed from a process cartridge of the laser beam printer, an electric-potential sensor was fixed to the position where the developer unit had been installed, and the photosensitive member of the process cartridge was replaced by the above-explained electrophotographic photosensitive member. A transfer roller was removed from the main body of the printer and, after carrying out a solid black image mode (i.e., the entire surface was subjected to light exposure) electrophotographic process on 5 sheets of A4-size paper, the electric potential of the surface of the photosensitive member was measured and defined as VL. Then the electrophotographic photosensitive member was allowed to rotate 5 times under continuous laser exposure with the primary charging de-energized. The electric potential of the surface of the electrophotographic photosensitive member was measured again and defined as the residual electric potential (Vr).

In addition, a paper-copying durability test using 10,000 sheets was carried out by using an ordinary process cartridge of the laser beam printer LBP-NX, wherein the electrophotographic photosensitive member of the cartridge had been replaced by the above-mentioned electrophotographic photosensitive member. The resultant images were visually examined. Immediately after the durability test, VL of the photosensitive member was measured according to the same manner as the above. The results are shown in Table 1.

Another protective layer was formed on a quartz-glass plate 1 mm thick by the same method as mentioned above to measure light transmittance at 780 nm. The result is also shown in Table 1.

EXAMPLE 2

An electrophotographic photosensitive member was produced and evaluated according to the same manner as in Example 1, except that the protective layer thereof was formed by the method as described below. The results are shown in Table 1.

The following materials were mixed and dispersed for 72 hours by a sand mill: 100 parts of $Ta_2O_5$-doped tin oxide particles—the primary particles of which had an average diameter of 0.02 μm and the resistivity of which was $2\times10^1$ Ω·cm; 90 parts of a resol-type phenol resin having a solid content of 70% (trade name: Pli-O-Phen J-325, manufactured by Dainippon Ink and Chemicals, Incorporated), and 300 parts of methyl isobutyl ketone.

The resuling solution was applied to the charge transport layer by spray coating followed by heating at 140° C. for 30 min. to form a protective layer 4 μm thick. The resistivity of a layer prepared according to the same method as this protective layer was $5\times10\ \Omega^{13}$·cm when measured by the above-mentioned manner.

EXAMPLE 3

An electrophotographic photosensitive member was prepared and evaluated according to the same manner as in Example 1, except that the protective layer thereof was formed by the method as described below. The results are shown in Table 1.

The following materials were mixed and dispersed for 72 hours by a sand mill: 100 parts of $Ta_2O_5$-doped tin-oxide particles—the primary particles of which had an average diameter of 0.02 μm and the resistivity of which was $2\times10^1$ Ω·cm; 80 parts of a methyletherified melamine-formaldehyde resin (trade name: Symer 303, manufactured by Mitsui Cyanamid), 300 parts of ethanol, and 20 parts of bisphenol compound having the following formula:

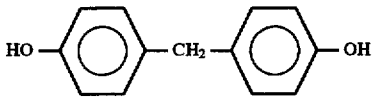

The resulting solution was applied to the charge transport layer by dip coating followed by heating at 140° C. for 2 hours to form a protective layer 4 μm thick. The resistivity of a layer prepared according to the same method as this protective layer was $5\times10^{13}$ Ω·cm when measured by the above-mentioned manner.

EXAMPLE 4

An electrophotographic photosensitive member was prepared and evaluated according to the same manner as Example 1, except that the thickness of the protective layer thereof was 6 μm. The results are shown in Table 1.

EXAMPLE 5

An electrophotographic photosensitive member was prepared and evaluated according to the same manner as in Example 1, except that the protective layer thereof was formed by the method as described below. The results are shown in Table 1.

The following materials were mixed and subjected to milling for 20 hours by a mill: 100 parts of $Ta_2O_5$-doped tin-oxide particles—the primary particles of which had an average diameter of 0.02 μm and the resistivity of which was $0.5\times10^1$ Ω·cm; 20 parts of (3,3,3-trifluoropropyl) trimethoxysilane (manufactured by Chisso Corporation), and 300 parts of ethanol. The resulting solution was filtered, washed with ethanol, dried, and heated for 2 hours at 150° C. so as to surface-treat the tin-oxide particles.

Then the following materials were mixed and dispersed for 96 hours by a sand mill: 12 parts of 2,4-diethylthioxanthone as an initiator for photopolymerization; 100 parts of the surface-treated tin-oxide particles doped with $Ta_2O_5$; 300 parts of ethanol, and 60 parts of acrylic monomer having the following formula:

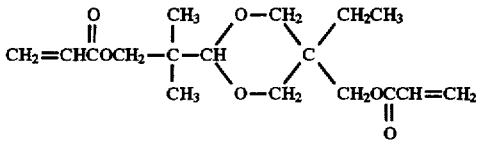

The resulting solution was applied to the charge transport layer by dip coating followed by drying and then ultraviolet radiation was applied for 20 seconds at 500 mW/cm$^2$ using a high-pressure mercury lamp to form a protective layer 4 μm thick. The resistivity of a layer prepared according to the same method as this protective layer was $5\times10^{12}$ Ω·cm when measured by the above-mentioned manner.

EXAMPLE 6

An photosensitive member was prepared and evaluated according to the same manner as in Example 1, except that the protective layer thereof was formed by the method as described below. The results are shown in Table 1.

The following materials were mixed and stirred for 48 hours by a stirring mill: 100 parts of $Ta_2O_5$-doped tin-oxide particles—the primary particles of which had an average diameter of 0.02 μm and the resistivity of which was $0.5\times10^1$ Ω·cm; 15 parts of (3,3,3-trifluoropropyl)trimethoxysilane (manufactured by Chisso Corporation), and 300 parts of ethanol. The resultant solution was filtered, washed with ethanol, dried, and heated for 2 hours at 150° C. so as to surface-treat the tin-oxide particles.

Then the following materials were mixed and dispersed for 96 hours by a sand mill: 12 parts of 2,4-diethylthioxanthone as an initiator for photopolymerization; 100 parts of the surface-treated tin-oxide particles doped with $Ta_2O_5$; 300 parts of ethanol, and 60 parts of acrylic monomer having the following formula:

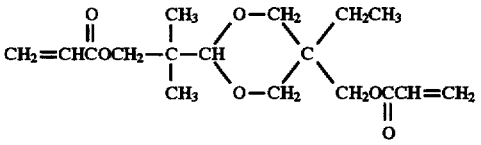

After that, 40 parts of tetrafluoroethylene resin particles (trade name: Lublon L-2, manufactured by Daikin Industries, Ltd.) were mixed in the resulting solution and further dispersed by a sand mill for 4 hours.

The resulting solution was applied to the charge transport layer by did coating followed by drying and then ultraviolet radiation was applied for 20 seconds at 500 mW/cm$^2$ using a high-pressure mercury lamp to form a protective layer of 4 μm thick. The resistivity of a layer prepared according to the same method as this protective layer was $1\times10^{13}$ Ω·cm when measured by the above-mentioned manner.

Comparative Example 1

An electrophotographic photosensitive member was prepared and evaluated according to the same manner as in Example 1, except that no protective layer was prepared.

Consequently, the initial electrophotographic characteristics were excellent as is shown in Table 1. However, deteriorated charging was observed due to shaving of the photosensitive layer after a durability test of 5,000 sheet.

Comparative Example 2

An electrophotographic photosensitive member was prepared and evaluated according to the same manner as in Example 1, except that antimony-doped tin-oxide particles—the primary particles of which had an average diameter of 0.02 μm and the resistivity of which was 2 Ω·cm were employed instead of the $Ta_2O_5$-doped tin oxide particles. The results are shown in Table 1.

Consequently, the light transmittance of the protective layer was low, the absolute values of the initial VL and Vr were high, and the lines of the resultant images became narrower. In the durability test, the absolute value of VL substantially decreased corresponding to an increase in shaving of the protective layer.

The resistivity of a layer prepared according to the same method as this protective layer was $1\times10^{12}$ Ω·cm when measured by the above-mentioned manner.

Comparative Example 3

An electrophotographic photosensitive member was prepared and evaluated according to the same manner as Example 1, except that tin-oxide-doped indium-oxide particles (trade name: ITO, manufactured by Mitsubishi Materials Corporation)—the primary particles of which had an average diameter of 0.03 μm and the resistivity of which was $0.1\times10^1$ Ω·cm were employed instead of the $Ta_2O_5$-doped tin oxide particles. The results are shown in Table 1.

Consequently, the light transmittance of the protective layer was low, the absolute value of the initial VL was high, and the lines of the resultant images became narrower. In the durability test, the absolute value of VL substantially decreased corresponding to an increase in shaving of the protective layer.

The resistivity of a layer prepared according to the same method as this protective layer was $8\times10^{11}$ Ω·cm when measured by the above-mentioned manner.

Comparative example 4

An electrophotographic photosensitive member was prepared and evaluated according to the same manner as in Example 1, except that titanium oxide particles—the primary particles of which had an average diameter of 0.03 μm and the resistivity of which was $6\times10^2$ Ω·cm were employed instead of the $Ta_2O_5$-doped tin oxide particles. The results are shown in Table 1.

Consequently, the light transmittance of the protective layer was high, but the resistivity of the protection layer was too high. As a result, the absolute value of the initial VR was too high, and the density of the resultant images became reduced and a negative ghost was observed. The durability test was not carried out.

The resistivity of a layer prepared according to the same method as this protective layer was $1.5\times10^{15}$ Ω·cm when measured by the above-mentioned manner.

TABLE 1

| | Light transmittance of surface protective layer (%) | Electric potential characteristics Initial VL (V) | Initial Vr (V) | Immediately after 10,000 sheets VL (V) | Immediately after 10,000 sheets change (V) | Initial image characteristics |
|---|---|---|---|---|---|---|
| Example 1 | 94 | −160 | −30 | −140 | 20 | Satisfactory |
| Example 2 | 94 | −160 | −45 | −140 | 20 | " |
| Example 3 | 94 | −160 | −45 | −140 | 20 | " |
| Example 4 | 90 | −165 | −50 | −145 | 20 | " |
| Example 5 | 97 | −155 | −35 | −140 | 15 | " |
| Example 6 | 93 | −160 | −40 | −145 | 15 | " |
| Comparative example 1 | — | −150 | −20 | −50 | 100 | " |
| Comparative example 2 | 79 | −195 | −50 | −140 | 55 | Narrowed line width |
| Comparative example 3 | 58 | −210 | −30 | −140 | 70 | Narrowed line width |
| Comparative example 4 | 90 | −330 | −100 | — | — | Reduced image density Negative ghost |

What is claimed is:

1. An electrophotographic photosensitive member comprising a support, a photosensitive layer provided on said support, and a surface layer provided on said photosensitive layer, wherein said surface layer comprises tantalum-doped tin oxide particles and a resin.

2. An electrophotographic photosensitive member according to claim 1, wherein said resin is a curable resin.

3. An electrophotographic photosensitive member according to claim 1, wherein said tantalum-doped tin oxide particles include a finishing agent adhered to the surface of said particles.

4. An electrophotographic photosensitive member according to claim 3, wherein said finishing agent is selected from the group consisting of silane coupling agents, silicone oils, siloxane compounds, and surface active agents.

5. An electrophotographic photosensitive member according to claim 4, wherein said finishing agent is fluorine-substituted.

6. An electrophotographic photosensitive member according to claim 1, wherein said surface layer further comprises fluorine-containing resin particles.

7. An electrophotographic photosensitive member according to claim 1, wherein the resistivity of said tantalum-doped tin-oxide is $10^2$ Ω·cm or less.

8. An electrophotographic photosensitive member according to claim 1, wherein the resistivity of said surface layer is $10^{10}$ to $10^{15}$ Ω·cm.

9. An electrophotographic photosensitive member according to claim 1, wherein said tantalum doped in said tin oxide is a tantalum oxide.

10. An electrophotographic photosensitive member according to claim 9, wherein said tantalum oxide is $Ta_2O_5$.

11. A process cartridge comprising (a) an electrophotographic photosensitive member and (b) at least one means selected from the Group consisting of a charging means, a developing means, and a cleaning means;

both said (a) and (b) being integrally supported as one body and being detachable from the main body of an electrophotographic apparatus; and said electrophotographic photosensitive member comprising a support, a photosensitive layer provided on said support, and a surface layer provided on said photosensitive layer; wherein said surface layer comprises tantalum-doped tin oxide particles and a resin.

12. An electrophotographic apparatus comprising an electrophotographic photosensitive member, a charging means, an exposure means, a developing means, and a transfer means, said electrophotographic photosensitive member comprising a support, a photosensitive layer provided on said support, and a surface layer provided on said photosensitive layer, wherein said surface layer comprises tantalum-doped tin oxide particles and a resin.

* * * * *

UNITED STATES PATENT AND TRADEMARK OFFICE

CERTIFICATE OF CORRECTION

PATENT NO. : 5,693,443

DATED : December 2, 1997

INVENTOR(S): KAZUSHIGE NAKAMURA ET AL.

It is certified that error appears in the above-identified patent and that said Letters Patent is hereby corrected as shown below:

ON TITLE PAGE

Insert --[30] Foreign Application Priority Data
Nov. 24, 1995 [JP] ..... 7-305492--.

ON TITLE PAGE AT [56] OTHER PUBLICATIONS

"(P-535" should read --(P-535)--.

COLUMN 2

Line 66, "achieved" should read --achieved;--.

COLUMN 7

Line 33, "a" should read --an--.

COLUMN 8

Line 19, "buthanol." should read --butanol.--.

COLUMN 11

Line 18, "An" should read --An electrophotographic--;
Line 50, "did" should read --dip--;
Line 63, "5,000 sheet." should read --5,000 sheets.--.

UNITED STATES PATENT AND TRADEMARK OFFICE

CERTIFICATE OF CORRECTION

PATENT NO. : 5,693,443

DATED : December 2, 1997

INVENTOR(S): KAZUSHIGE NAKAMURA ET AL. Page 2 of 2

It is certified that error appears in the above-identified patent and that said Letters Patent is hereby corrected as shown below:

COLUMN 14

Line 30, "Group" should read --group--.

Signed and Sealed this

Twelfth Day of May, 1998

Bruce Lehman

*Attest:*

BRUCE LEHMAN

*Attesting Officer*

*Commissioner of Patents and Trademarks*